US011918879B2

(12) United States Patent
Duffey

(10) Patent No.: US 11,918,879 B2
(45) Date of Patent: Mar. 5, 2024

(54) GOLF SWING TRAINER

(71) Applicant: Michael Duffey, State College, PA (US)

(72) Inventor: Michael Duffey, State College, PA (US)

( * ) Notice: Subject to any disclaimer, the term of this patent is extended or adjusted under 35 U.S.C. 154(b) by 0 days.

(21) Appl. No.: 17/066,622

(22) Filed: Oct. 9, 2020

(65) Prior Publication Data

US 2021/0106898 A1 Apr. 15, 2021

Related U.S. Application Data

(60) Provisional application No. 62/912,814, filed on Oct. 9, 2019.

(51) Int. Cl.
*A63B 69/36* (2006.01)

(52) U.S. Cl.
CPC ..... *A63B 69/3632* (2013.01)

(58) Field of Classification Search
CPC ..... A63B 69/3632; A63B 69/3676; A63B 69/3685; A63B 53/0487; A63B 2053/0491; A63B 53/007; A63B 53/065
USPC ..... 473/256, 334–339
See application file for complete search history.

(56) References Cited

U.S. PATENT DOCUMENTS 2,155,830 A * 4/1939 Howard ..... A63B 53/06 473/246
3,220,733 A * 11/1965 Saleeby ..... A63B 53/0487 473/335
4,607,846 A * 8/1986 Perkins ..... A63B 53/047 473/336
4,804,181 A * 2/1989 Foster ..... A63B 60/08 473/206
4,895,371 A * 1/1990 Bushner ..... A63B 60/02 473/336
5,193,805 A * 3/1993 Solheim ..... A63B 53/047 473/291
5,769,737 A * 6/1998 Holladay ..... A63B 53/06 473/336
6,015,354 A * 1/2000 Ahn ..... A63B 53/0466 473/256
6,379,264 B1 * 4/2002 Forzano ..... A63B 60/02 473/336
7,166,041 B2 * 1/2007 Evans ..... A63B 53/0466 473/334
7,232,380 B2 * 6/2007 Nakahara ..... A63B 53/047 473/335
7,572,193 B2 * 8/2009 Yokota ..... A63B 60/02 473/328
7,704,163 B2 * 4/2010 Stites ..... A63B 53/047 473/334

(Continued)

*Primary Examiner* — Sebastiano Passaniti
(74) *Attorney, Agent, or Firm* — Penn State Law IP Clinic

(57) ABSTRACT

There are numerous tools a golfer can buy that will increase or decrease the weight or moment of inertia of a club to increase swing speed, but none of these tools accurately represent the center of mass of a standard golf club. The differences in the center of the mass between the standard club and the trainer club can create problems with the swing including improper alignment of the club face through contact and improper swing path. A swing trainer that increases or decreases the moment of inertia of the trainer by 10-12% while still maintaining the same center of mass as a standard club can solve this issue.

17 Claims, 17 Drawing Sheets

(56) References Cited

U.S. PATENT DOCUMENTS

| | | | | |
|---|---|---|---|---|
| 7,775,905 | B2 * | 8/2010 | Beach | A63B 53/06 473/334 |
| 8,715,106 | B1 * | 5/2014 | Seluga | A63B 53/047 473/335 |
| 9,061,186 | B2 * | 6/2015 | Larson | A63B 53/047 |
| 9,238,162 | B2 * | 1/2016 | Breier | A63B 60/52 |
| 10,022,595 | B2 * | 7/2018 | Dolezel | A63B 60/02 |
| 10,052,534 | B1 * | 8/2018 | Ines | A63B 60/02 |
| 10,071,292 | B2 * | 9/2018 | Wu | A63B 53/047 |
| 10,258,839 | B2 * | 4/2019 | Beck | A63B 53/02 |
| 2002/0115502 | A1 * | 8/2002 | Fountain | A63B 53/065 473/334 |
| 2008/0020861 | A1 * | 1/2008 | Adams | A63B 53/047 473/336 |
| 2011/0009210 | A1 * | 1/2011 | Stites | A63B 53/06 473/336 |
| 2016/0271464 | A1 * | 9/2016 | Murphy | A63B 60/04 |
| 2019/0046846 | A1 * | 2/2019 | Sargent | A63B 53/06 |
| 2019/0083862 | A1 * | 3/2019 | Jertson | A63B 53/0466 |
| 2019/0091529 | A1 * | 3/2019 | Hebreo | A63B 53/06 |

* cited by examiner

GOLF SWING TRAINER

CROSS-REFERENCE

This application claims the benefit of U.S. Provisional Application No. 62/912,814 filed 10/9/2019, which application is incorporated herein by reference.

BACKGROUND OF THE INVENTION

Many golfers want to increase their swing speed to increase the distance they can hit a golf ball and potentially lower their average score. There are numerous tools a golfer can use to increase swing speed, but none of them accurately represent the center of mass of a golf club. The differences in the center of the mass between the standard club and a trainer club can create problems with the swing including improper alignment of the club face through contact and improper swing path. This can be due to a lack of weight or weight distributed in a manner that is not consistent with how a non-trainer golf club's weight is distributed.

In golf, a player may only have an approximately 15 degree span to hit the ball in play from the tee box and it may be less on subsequent shots on the hole. Therefore, the swing speed trainer for club also has to focus on maintaining the mechanics of the swing as well as increasing the swing speed.

The swing speed trainer disclosed herein is adjustable to improve club face control, and to represent the center of mass of a golf club more accurately while increasing or decreasing the moment of inertia from a standard golf club by as much as 10-12%.

SUMMARY OF THE INVENTION

In some embodiments, a golf club trainer comprises a club head including a sliding track. The golf club trainer also includes a weight slidably attached to the sliding track of the club head and a locking mechanism configured to secure the weight to the sliding track.

In some embodiments, a method of adjusting a center of gravity and a distribution of mass of a golf cub trainer comprises releasing a locking mechanism, sliding a weight, and securing the locking mechanism. By releasing the locking mechanism, the weight is secured to a sliding track embedded in a club head of the golf club trainer. The weight may then be slid along the sliding track to a desired position. By securing the locking mechanism, further movement of the weight is prevented.

The general description of the following detailed description are exemplary and explanatory only and are not meant to be restrictive. Other aspects and variations of the present application will be apparent to those skilled in the art in view of the detailed description of the invention as provided herein.

INCORPORATION BY REFERENCE

All publications, patents, and patent applications mentioned in this specification are herein incorporated by reference to the same extent as if each individual publication, patent, or patent application was specifically and individually indicated to be incorporated by reference.

BRIEF DESCRIPTION OF THE DRAWINGS

The novel features of the invention are set forth with particularity in the appended claims. A better understanding of the features and advantages of the present invention will be obtained by reference to the following detailed description that sets forth illustrative embodiments, in which the principles of the invention are utilized, and the accompanying drawings of which:

FIG. 1 is an exemplary illustration of different views of an underweight slider.

FIG. 3 is an exemplary illustration of different views of an overweight slider.

FIG. 6 is an exemplary illustration of a boat shaped embodiment of the trainer head with a track for weight sliders to be moved and attached by a nut and bolt system.

FIG. 11 is an exemplary illustration of different views of an embodiment of the trainer head with an exposed sliding track for a fixed sliding mass and a spring loaded release to insert additional loaded masses.

FIG. 12 is an exemplary illustration of different views of an additional loaded mass for an embodiment of the trainer head with an exposed sliding track.

FIG. 13 is an exemplary illustration of different views of the fixed weight sliding mass for an embodiment of the trainer head.

DETAILED DESCRIPTION OF THE INVENTION

In one embodiment of the golf swing trainer, the adjustable weight club head is made out of steel. A golf swing trainer needs to be efficient in terms of weight and material properties. This embodiment with a steel adjustable weight club head provides a durable material with an ideal density desirable for this purpose. This embodiment allows a strong sleek design. This embodiment of steel is both readily available to 3D print and machinable.

Figure 6A:
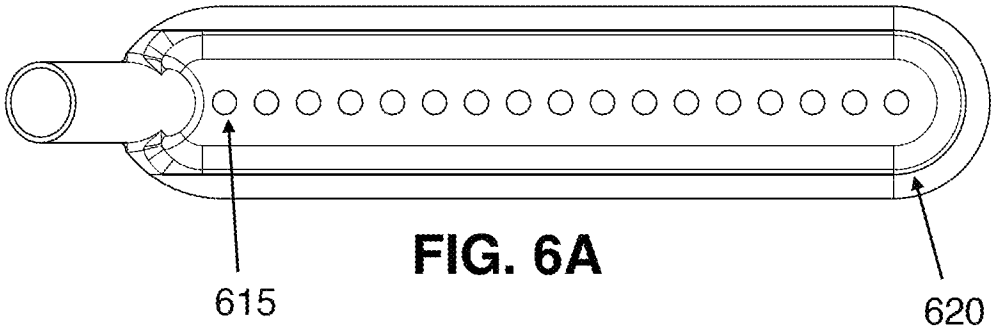
FIG. 6A depicts a view of the top of the club head body looking down.
Figure 6C:
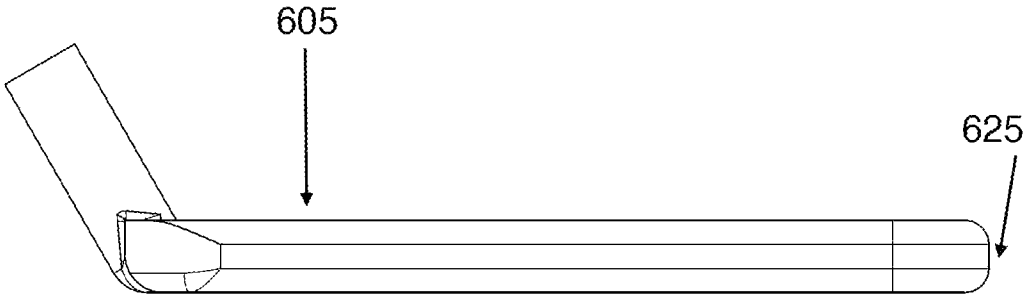
FIG. 6C depicts a lateral view of the club head body with no hosel.
Figure 6B:
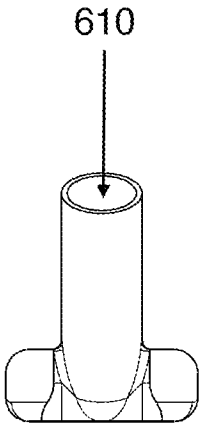
FIG. 6B depicts the hosel from a dorsal view with the club head body pointing away from the viewer.

The club head can be any shape to accommodate weights. The illustration in FIG. 6A conveys an illustration of an embodiment of the club head as boat-shaped. One skilled in the art will recognize that other shapes can be used to accommodate sliding on additional weight. In some embodiments the club head body is approximately 4.5 inches in length from the bottom of the hosel to the opposite end. In some embodiments the club head body is 1 inch wide. In some embodiments the club head body is approximately 0.38 inches tall excluding the hosel. In some embodiments, the hosel is approximately 1.25 inches from the upper opening of the hosel to the club head body. In this embodiment, the user can slide weights around the long body portion of the club head body (605). In some embodiments, the user can attach the weight to the club head by inserting a bolt in the hole (615) and securing with a nut. In some embodiments, the body has walls around the edges (620), e.g. to add support. In some embodiments, the club head body has filleted edges (625), e.g., to keep the weight down. In some embodiments the club head body contains a hosel (610) where the shaft connects to the club head.

In some embodiments, a slider-like weight will be added to the club head body to increase the trainer club head's mass. In some embodiments, the club head body mass is lower than a standard driver. In some embodiments, the mass of the trainer without any slider-like weights is approximately: 120 g, 121 g, 122 g, 123 g, 124 g, 125 g, 126 g, 127 g, 128 g, 129 g, 130 g, 131 g, 132 g, 133 g, 134 g, 135 g, 136 g, 137 g, 138 g, 139 g, 140 g, 141 g, 142 g, 143 g, 144 g, 145 g, 146 g, 147 g, 148 g, 149 g, 150 g, 151 g, 152 g, 153 g, 154 g, 155 g, 156 g, 157 g, 158 g, 159 g, 160 g, 161 g, 162 g, 163 g, 164 g, 165 g, 166 g, 167 g, 168 g, 169 g, 170 g, 171 g, 172 g, 173 g, 174 g, 175 g, 176 g, 177 g, 178 g, 179 g, 180 g. The club head of the golf swing trainer can be of a lower mass than a standard golf club driver head, e.g., so the user can add weights to match the offset center of mass of a normal golf club.

In some embodiments the slider-like weight can be an underweight weight, i.e. the total weight of the club head body plus underweight weight is less than the weight of a standard club head body. To make the golf swing trainer underweight by about 10% in comparison to a standard driver, the slider-like weight will weigh approximately: 35 g, 36 g, 37 g, 38 g, 39 g, 40 g, 41 g, 42 g, 43 g, 44 g, 45 g, 46 g, 47 g, 48 g, 49 g, 50 g, 51 g, 52 g, 53 g, 54 g, 55 g. The illustration in FIG. 1 conveys one embodiment of the slider-like weight. In some embodiments, the main body of the club head will slide through the gap (105) of the slider-like weight. In some embodiments, this slider-like weight will be attached to the body of the club head by fitting a screw through the hole (110) on the top of the slider-like weight, and securing the screw with a nut.

In some embodiments the slider-like weight can be an overweight weight, i.e. the total weight of the club head body plus overweight weight is greater than the weight of a standard club head body. To make the golf swing trainer overweight by about 10% in comparison to a standard driver, the slider-like weight will weigh approximately: 100 g, 101 g, 102 g, 103 g, 104 g, 105 g, 106 g, 107 g, 108 g, 109 g, 110 g, 111 g, 112 g, 113 g, 114, 115 g, 116 g, 117 g, 118 g, 119 g, 120 g, 122 g, 123 g, 124 g, 125 g. The illustration in FIG. 3 conveys one embodiment of the slider-like weight. In some embodiments, the main body of the club head will slide through the gap (305) of the slider-like weight. In some embodiments, this slider-like weight will be attached to the body of the club head by fitting a screw through the hole (310) on the top of the slider-like weight, and securing the screw with a nut.

Figure 1B:
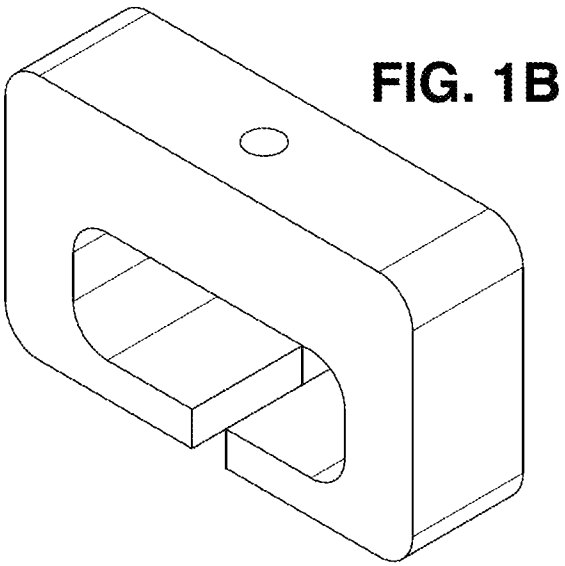
FIG. 1B depicts a lateral view of the underweight slider, with the view being rotated laterally roughly 45° and a rotated upwards roughly 45°.
Figure 1D:
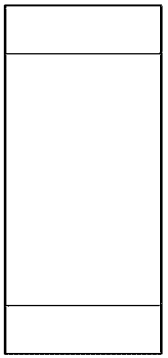
FIG. 1D depicts a different lateral view of the underweight slider, looking at the smaller faced side.
Figure 1A:
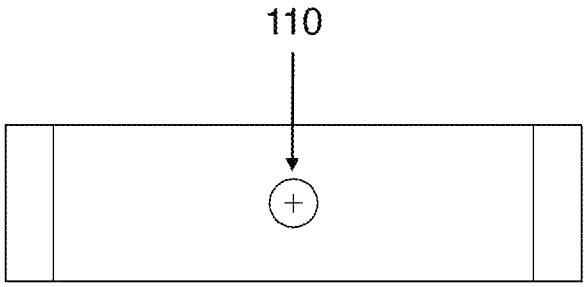
FIG. 1A depicts a view of the top of the underweight slider looking down.
Figure 1C:
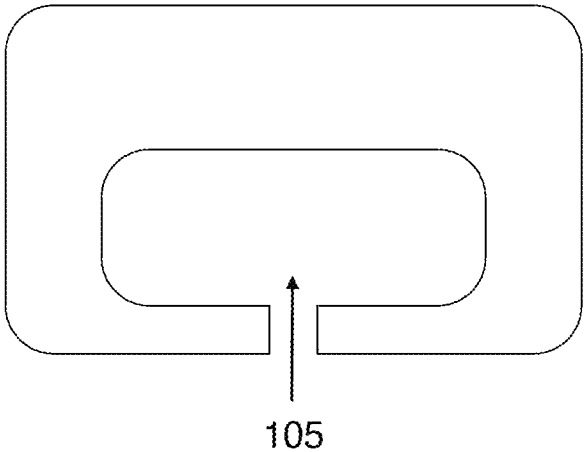
FIG. 1C depicts a lateral view of the underweight slider looking at the larger-faced side which contains the hole where the club head body will fit as the weight slides onto the club head body.
Figure 2:
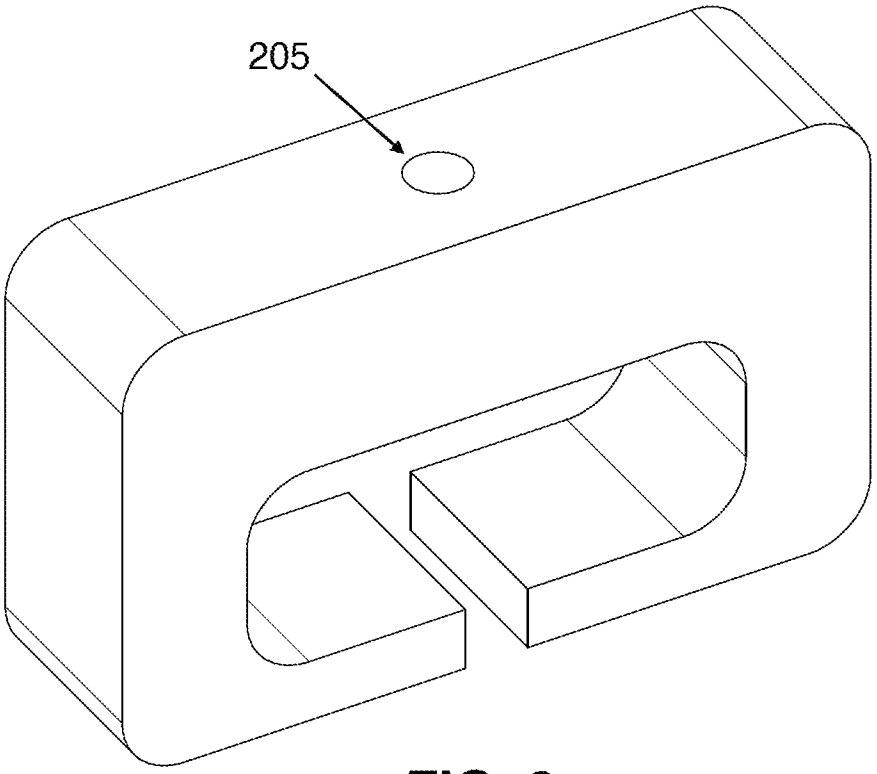
FIG. 2 is an exemplary illustration of an underweight slider.
Figure 3B:
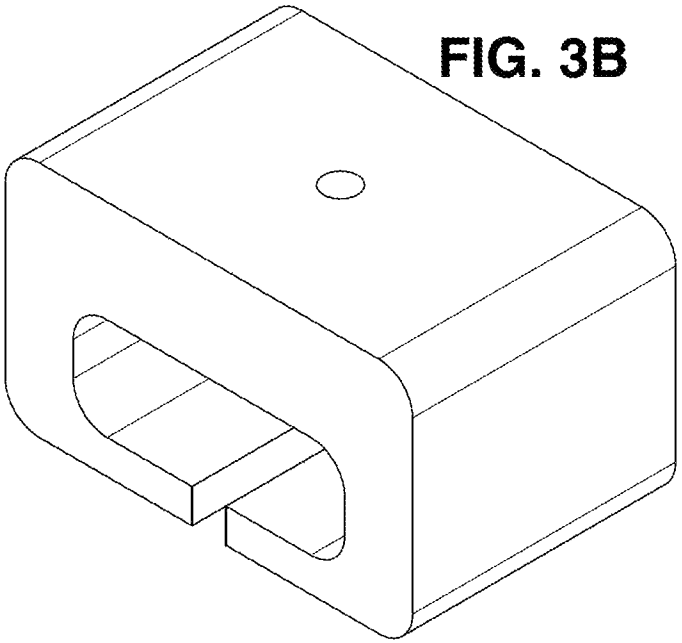
FIG. 3B depicts a lateral view of the overweight slider, with the view being rotated laterally roughly 45° and rotated upwards roughly 45° .
Figure 3D:
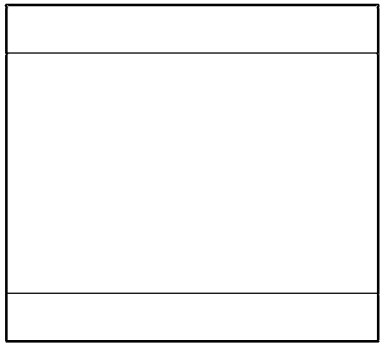
FIG. 3D depicts a different lateral view of the overweight slider, looking at the smaller faced side.
Figure 3A:
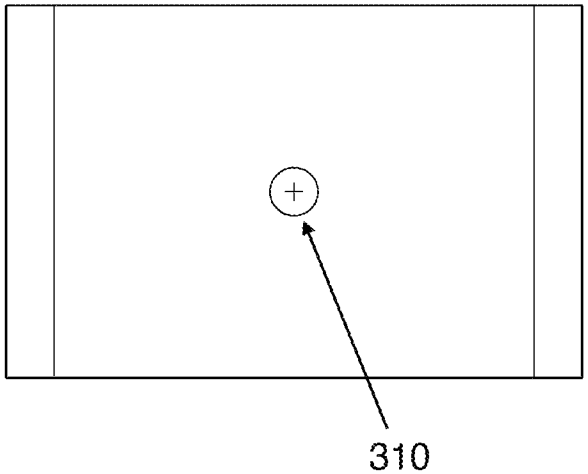
FIG. 3A depicts a view of the top of the overweight slider looking down.
Figure 3C:
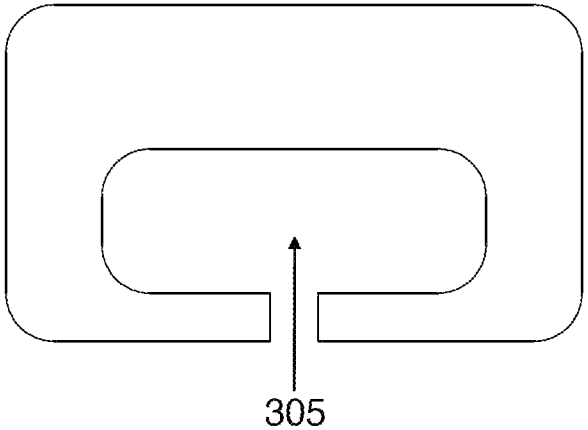
FIG. 3C depicts a lateral view of the overweight slider looking at the larger-faced side which contains the hole where the club head body will fit as the weight slides onto the club head body.
Figure 4:
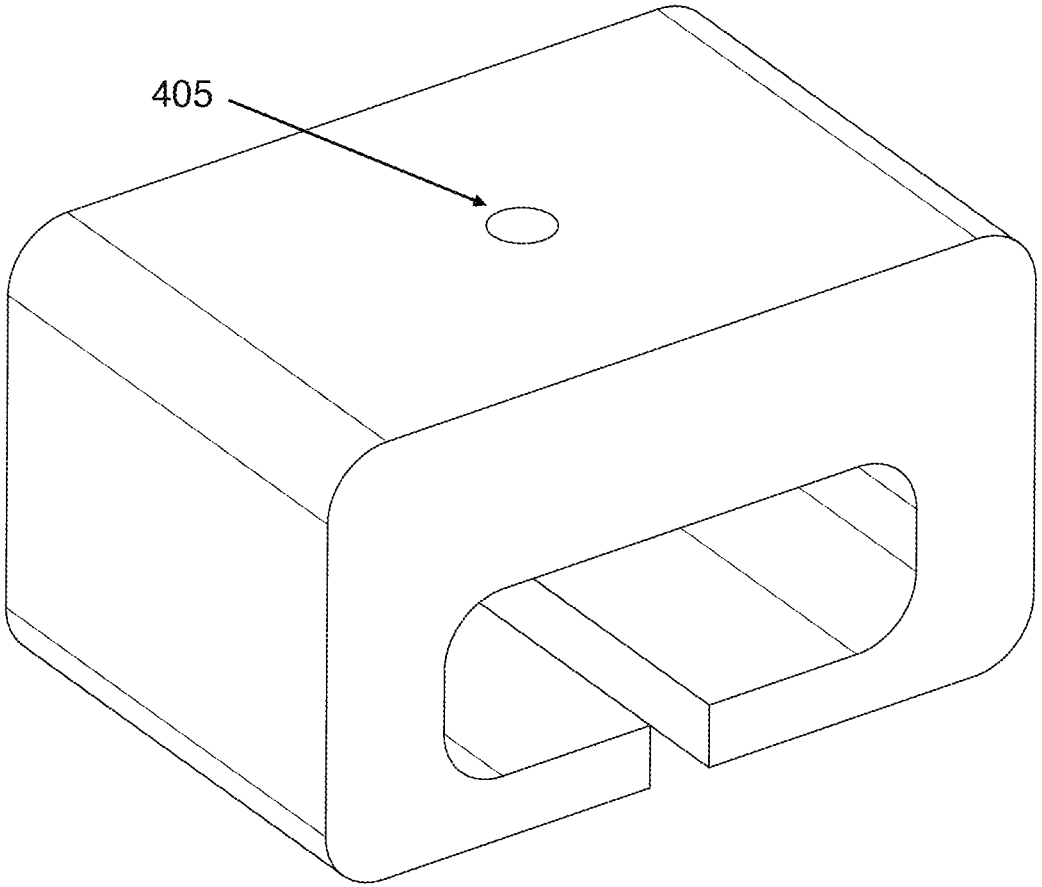
FIG. 4 is an exemplary illustration of an overweight slider.
Figure 5:
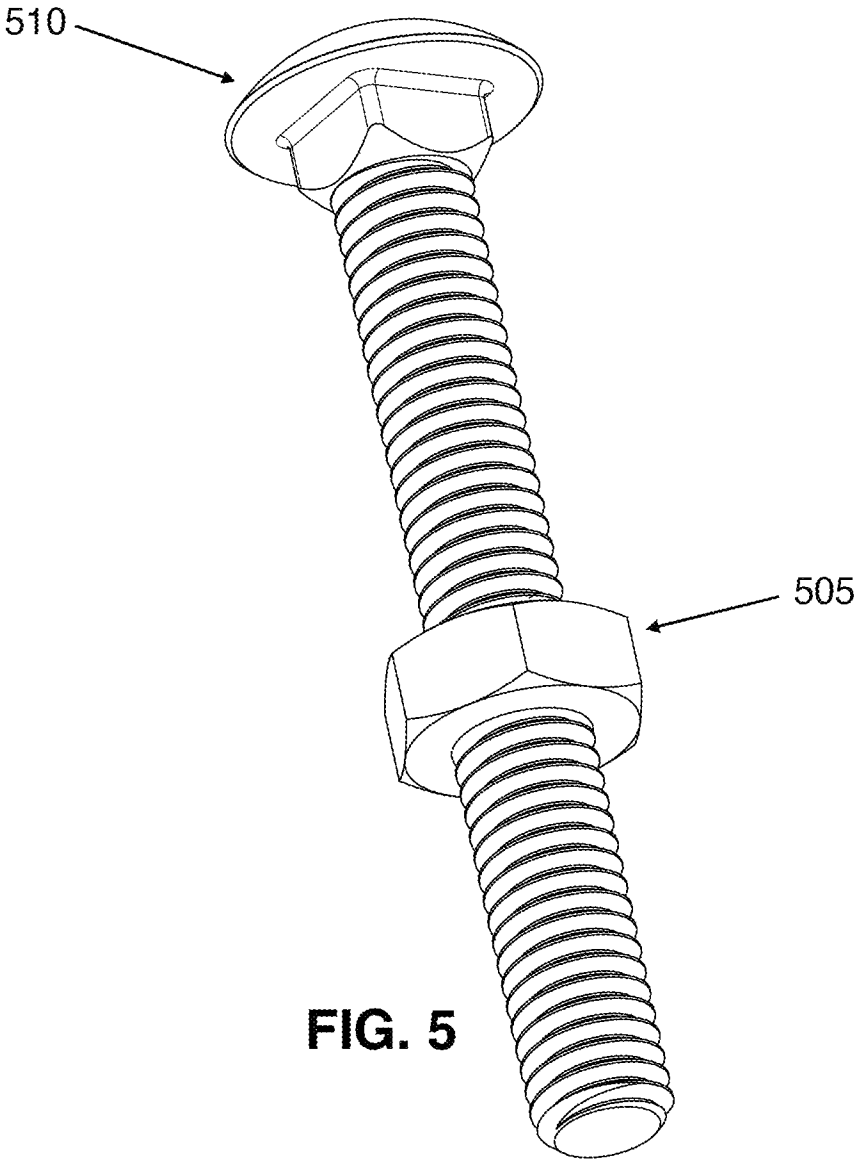
FIG. 5 is an exemplary illustration of the screw and nut that will attach the differing slider-like weights to the club head body.

An exemplary embodiment of a screw 510 and nut 505 configuration is shown in FIG. 5. The screw 510 may be inserted through the gap 105 of the slider-like weight and secured to the main body of the club head via the nut 505. It would be known to those skilled in the art that other types of fasteners or securing mechanisms may be used to replace the screw 510 and nut 505 configuration in other embodiments not exhaustively detailed herein.

In many embodiments, the golf trainer grip is responsive and lightweight to ensure correct swing mechanics and avoid fatigue with usage. In some embodiments, the grip is a mixture of rubber and polymer like materials for a unique and custom grip for golf club users. In some embodiments, the grip reduces strive to reduce grip weight, thus increasing club control and minimizing wrist movement.

Figure 7:
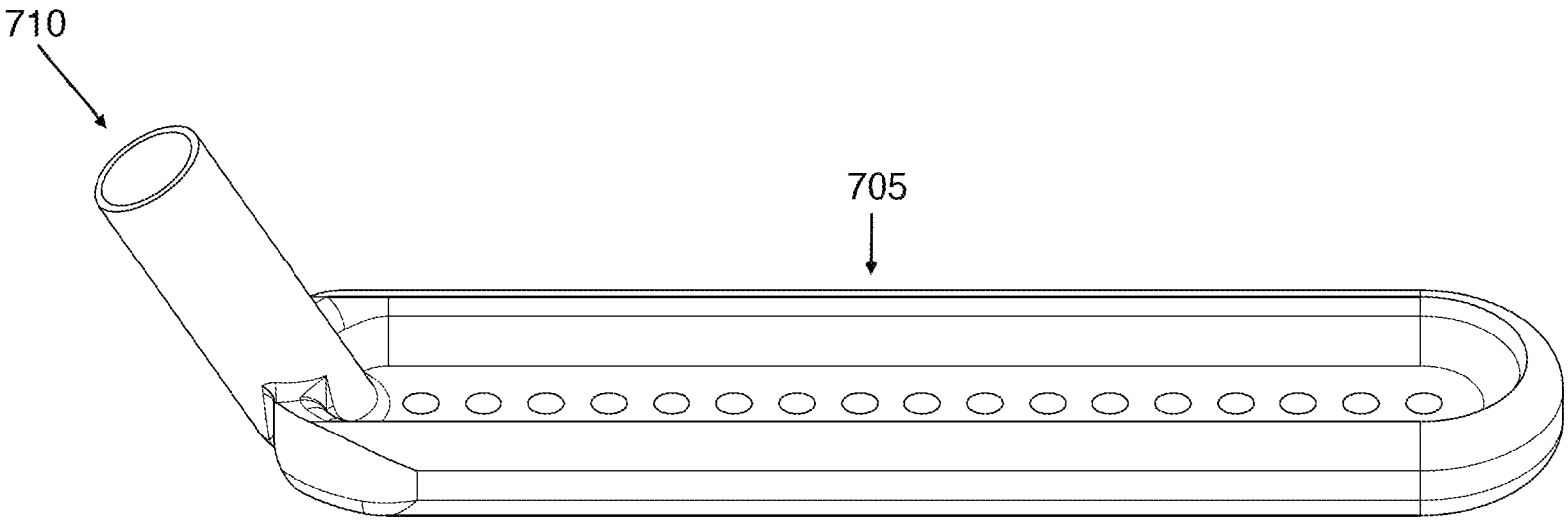
FIG. 7 is an exemplary illustration of an embodiment of the club head body looking down and laterally at the side and the top of the club head body.
Figure 8:
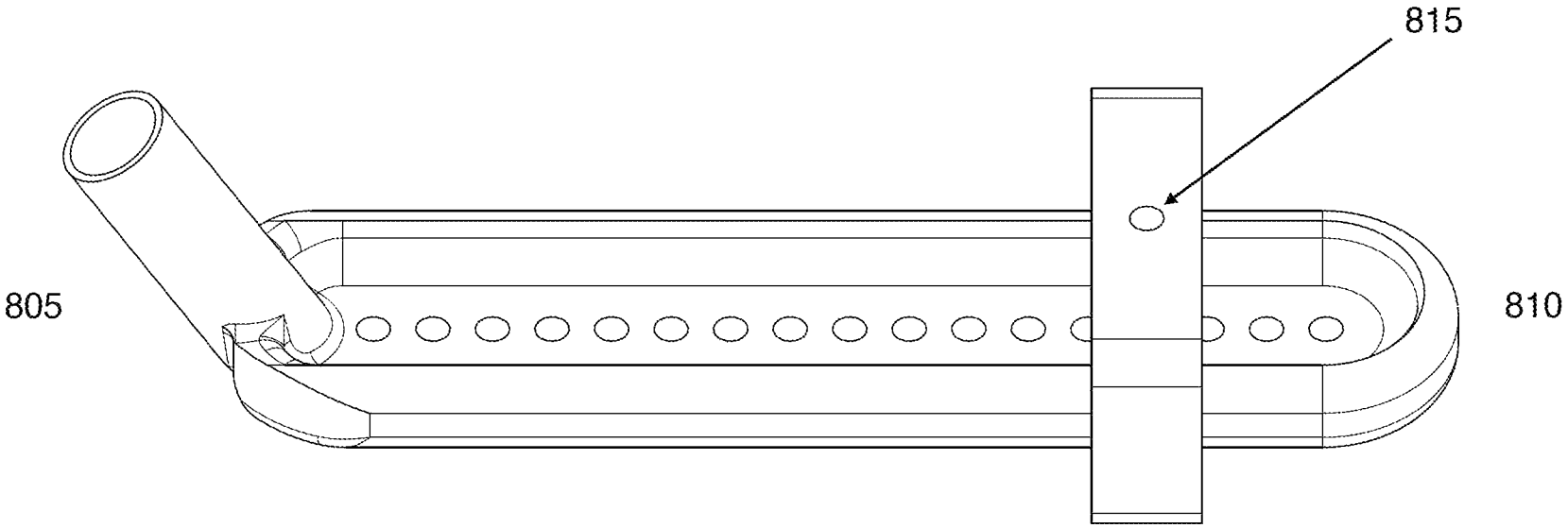
FIG. 8 is an exemplary illustration of how the underweight slider fits on to an embodiment of the club head body and where the underweight slider would be fixed.
Figure 9:
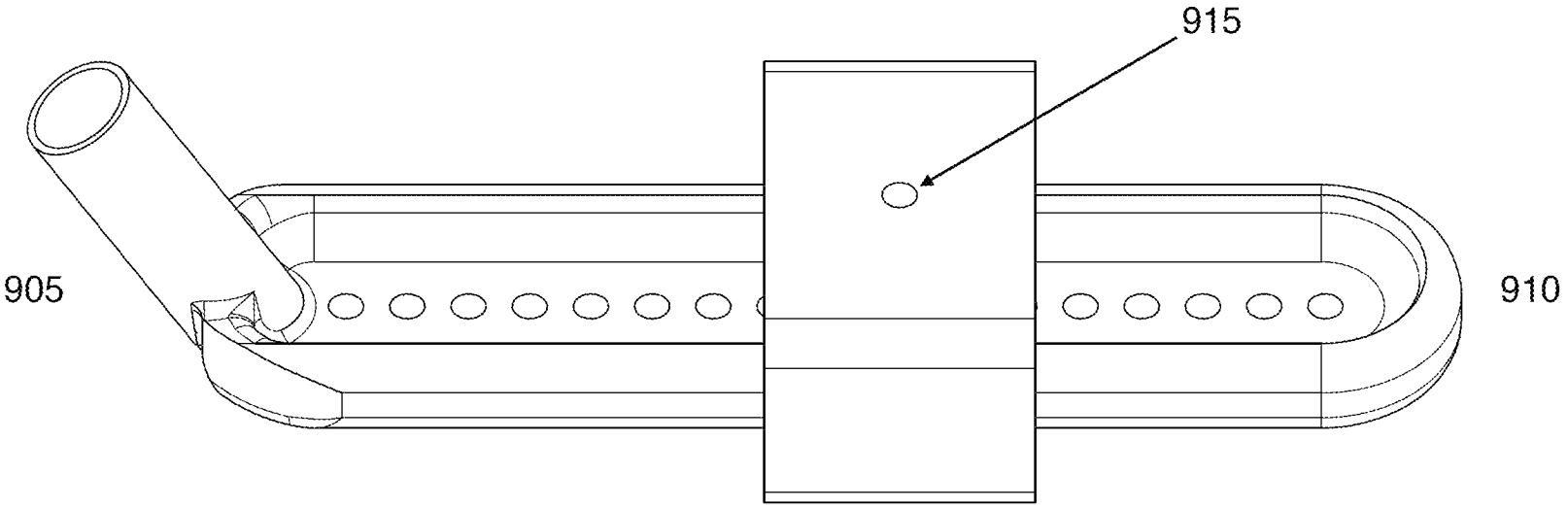
FIG. 9 is an exemplary illustration of how the overweight slider fits on to an embodiment of the club head body and where the overweight slider would be fixed.
Figure 10:
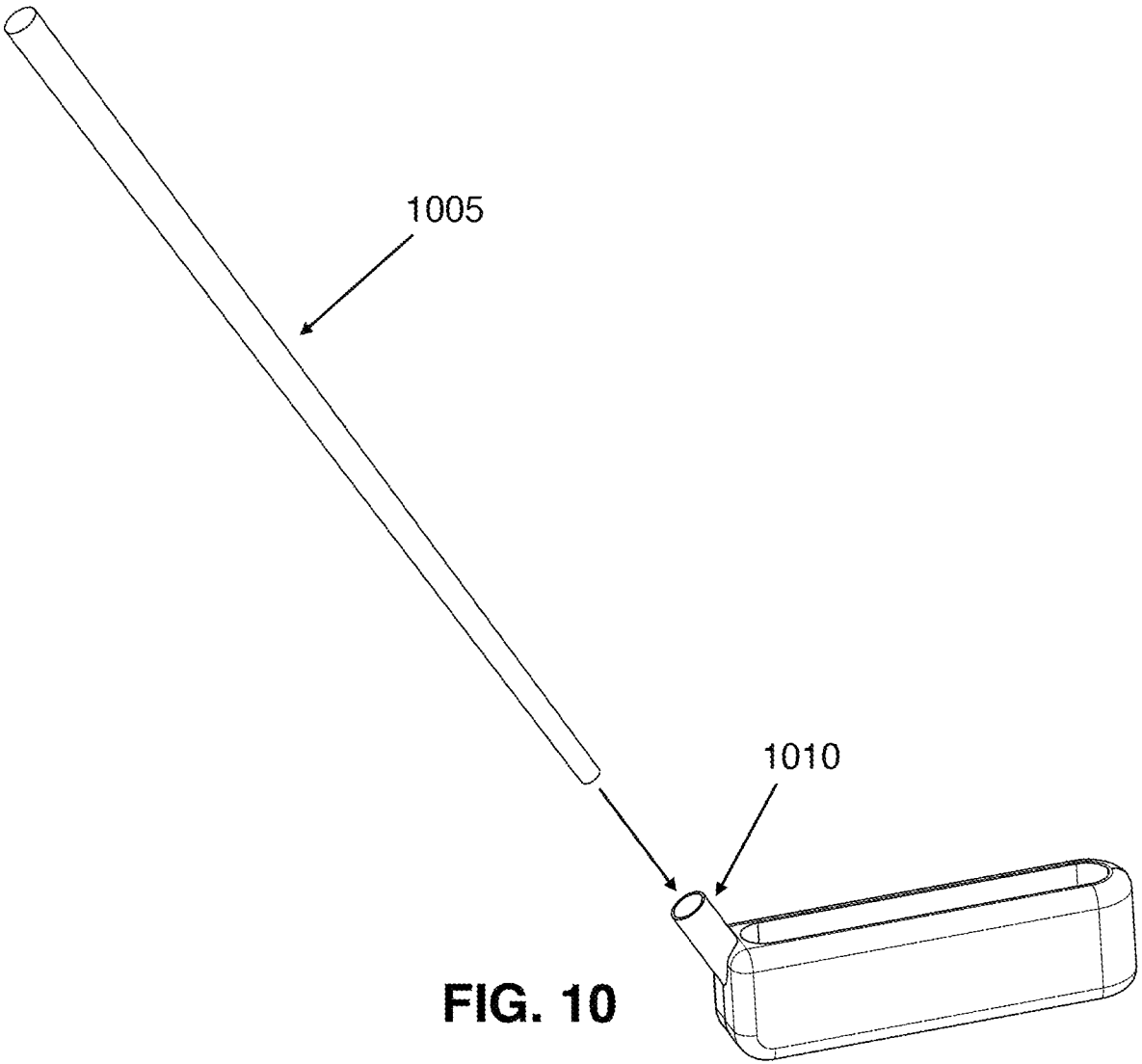
FIG. 10 is an exemplary illustration of the shaft to an embodiment of the club head body assembly.

In some embodiments, a standard golf club shaft is used to provide the most realistic feel in the swing. The illustration in FIG. 10 conveys one embodiment of how the golf club shaft attaches to the hosel of the club head body. The illustration in FIG. 7 conveys one embodiment of the golf club head body. In some embodiments, the golf club shaft is attached to the hosel of the club head body (710) using an epoxy-based connection.

In other embodiments of the golf swing trainer, the adjustable, steel weight club head has an exposed sliding track for a steel fixed weight sliding mass, and a spring loaded release to insert additional steel loaded masses, which provides a durable material with an ideal density. In some embodiments plastic can surround the steel structure.

This embodiment allows a sleek, user friendly design. This embodiment of steel is both readily available to 3D print and machinable.

Figure 11B:
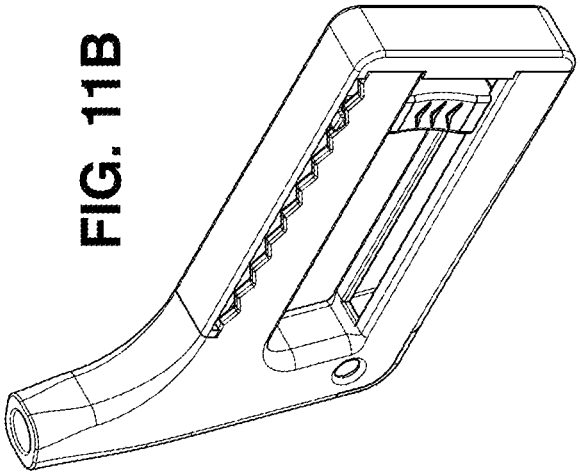
FIG11B depicts a lateral view of the second embodiment of the trainer head, with the view being rotated laterally roughly 45° and rotated upwards roughly 45° .
Figure 11D:
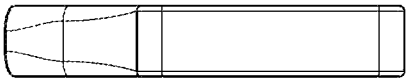
FIG11D depicts a view of the bottom of the trainer head looking up.
Figure 11A:
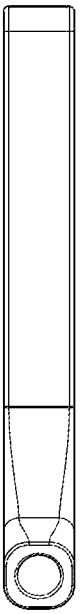
FIG. 11A depicts a view of the top of the trainer head looking down.
Figure 11C:
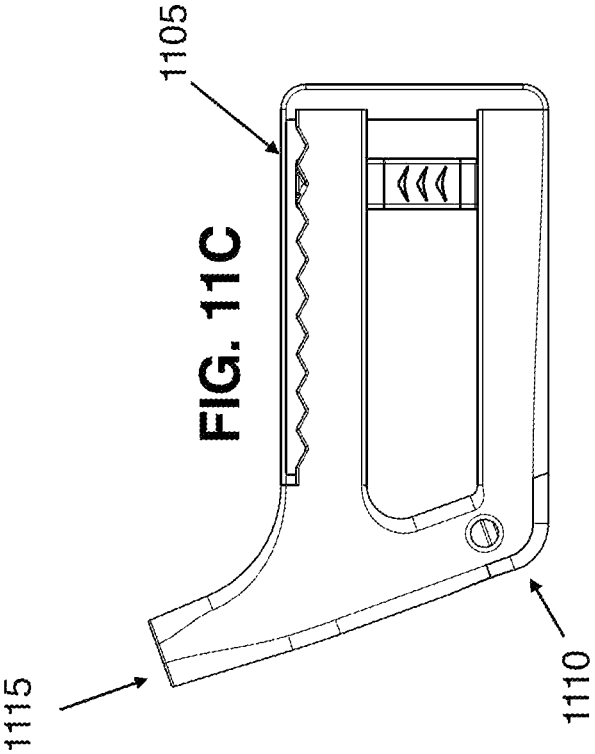
FIG. 11C depicts a lateral view of the trainer head showing the fixed sliding mass on the exposed track.
Figure 12B:
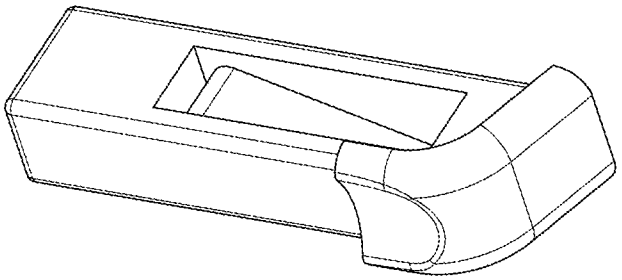
FIG. 12B depicts a lateral view of the additional loaded mass, with the view being rotated laterally roughly 45° and rotated downwards roughly 45° .
Figure 12D:
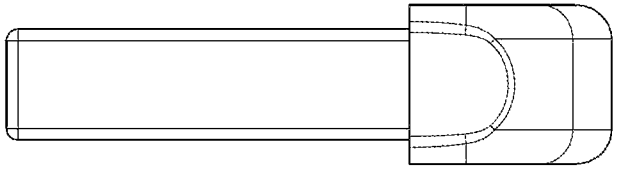
FIG. 12D depicts a view of the bottom of the additional loaded mass looking up.
Figure 12A:
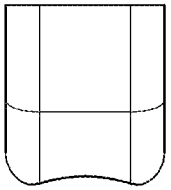
FIG. 12A depicts the additional loaded mass from a dorsal view with no hosel.
Figure 12C:
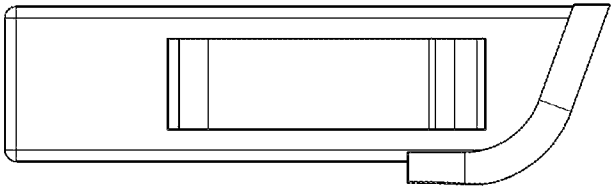
FIG. 12C depicts a lateral view of the additional loaded mass showing the exposed sliding track.
Figure 13B:
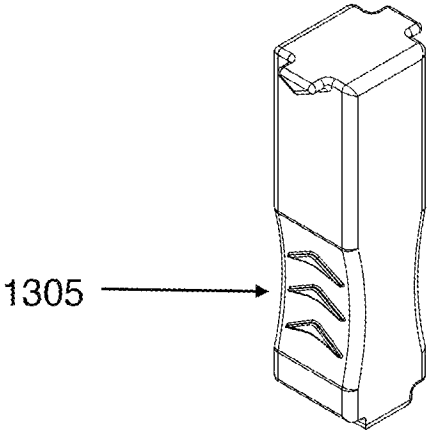
FIG13B depicts a lateral view of the fixed weight sliding mass, with the view being rotated laterally roughly 45° and rotated upwards roughly 45° .
Figure 13D:
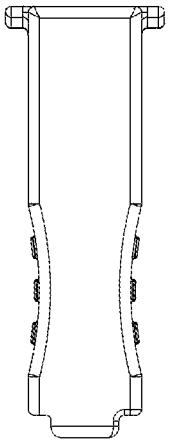
FIG. 13D depicts a different lateral view of the fixed weight sliding mass.
Figure 13A:
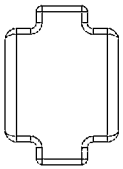
FIG. 13A depicts a view of the top of the fixed weight sliding mass looking down.
Figure 13C:
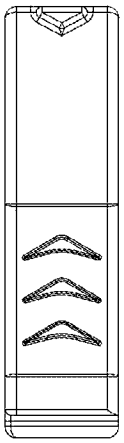
FIG. 13C depicts a different lateral view of the fixed weight sliding mass.
Figure 14:
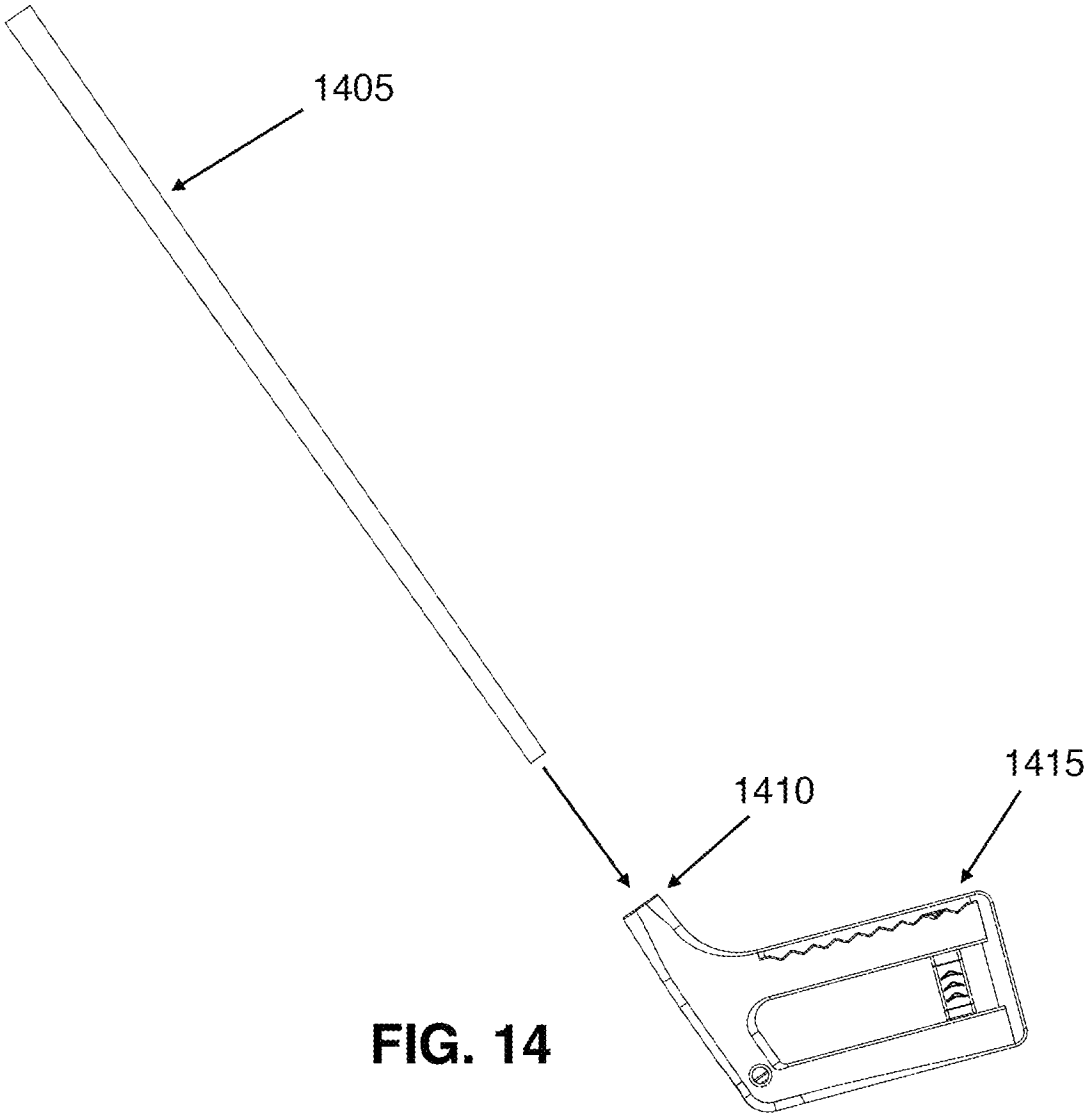
FIG. 14 is an exemplary illustration of the shaft to club head body assembly for an embodiment of the trainer head.

The illustration in FIG. 11C conveys an illustration of an embodiment of the club head as rectangular shaped, including a top edge, a bottom edge, a front edge, a rear edge, and two faces extending along a longitudinal direction of the club head. One skilled in the art will recognize that other shapes can be used to accommodate inserting additional loaded masses. In some embodiments, the club head body is approximately 4.7 inches in length from the top of the hosel to the opposite end. In some embodiments, the club head body is approximately 0.55 inches wide. In some embodiments, the club head body is approximately 2.09 inches tall, excluding the hosel. In some embodiments, the club head body contains a hosel (1115) where the shaft connects to the club head.

In the embodiment shown in FIGS. 11-13, the user can slide the fixed weight sliding mass (shown in FIG. 13) along the exposed sliding track (1105) that extends along the longitudinal direction of the club head from the front edge to the rear edge. The position of the weight along the sliding track (1105) changes the rotational resistance of the golf club trainer. In some embodiments, the fixed weight sliding mass is approximately 20 g. In some embodiments, the fixed weight sliding mass has filleted edges (1305) to keep the weight down. In some embodiments, the sliding track (1105) includes a grooved track extending along the longitudinal direction of the club head. The grooved track may include a plurality of grooves, each groove being configured to secure the fixed weight sliding mass at a desired location on the club head along the longitudinal direction from the front edge to the rear edge. The fixed weight sliding mass may also be coupled to a spring that biases the weight into a selected groove of the grooved track. In order to change the position of the fixed weight sliding mass, the spring must be biased to release the fixed weight sliding mass from the selected groove. While continuously biasing the spring, the fixed weight sliding mass may then be slid along the sliding track (1105) to a different desired location. When the spring is released, the weight is secured in a different selected groove such that movement along the longitudinal direction of the club is prevented. In some embodiments, a plurality of fixed weight sliding masses may be slidably attached to the sliding track (1105) of the golf club trainer club head.

In some embodiments, an additional removable mass (shown in FIG. 12) may be inserted into a hollow rear edge of the club head to change the golf club trainer's overall weight, center of gravity, and distribution of mass. The additional removable mass may be held in the hollow rear edge of the club head by a spring loaded locking pin (1110). To release and remove the additional removable mass from the club head, the locking pin (1110) is pushed inward until the locking hole on the club head rear edge is cleared, thus allowing the additional removable mass to slide out from the hollow rear edge of the club head.

In some embodiments, one of three additional loaded masses will be slid into the club head body through the spring loaded release to increase the trainer club head's mass. In some embodiments, the club head body mass is lower than a standard driver. In some embodiments, the mass of the trainer without any additional loaded masses is approximately: 140 g, 141 g, 142 g, 143 g, 144 g, 145 g, 146 g, 147 g, 148 g, 149 g, 150 g, 151 g, 152 g, 153 g, 154 g, 155 g, 156 g, 157 g, 158 g, 159 g, 160 g, 161 g, 162 g, 163 g, 164 g, 165 g, 166 g, 167 g, 168 g, 169 g, 170 g, 171 g, 172 g, 173 g, 174 g, 175 g, 176 g, 177 g, 178 g, 179 g, 180 g, 181 g, 182 g, 183 g, 184 g, 185 g, 186 g, 187 g, 188 g, 189 g, 190g. The club head of the golf swing trainer can be of a lower mass than a standard golf club driver head, e.g., so the user can add additional loaded masses to match the offset center of mass of a normal golf club.

In some embodiments the additional loaded mass can be an underweight weight, i.e. the total weight of the club head body plus underweight loaded mass is less than the weight of a standard club head body. To make the golf swing trainer underweight by about 10% in comparison to a standard driver, the additional loaded mass will weigh approximately 5 g. The illustration in FIG. 12 conveys one embodiment of the additional loaded mass. In some embodiments, the additional loaded mass will slide in through the opening made by the spring loaded release (1110).

In some embodiments the additional loaded mass can be a standard weight, i.e. the total weight of the club head body plus standard loaded mass is consistent with the weight of a standard club head body. To make the golf swing trainer consistent with a standard driver, the additional loaded mass will weigh approximately 25 g.

In some embodiments the additional loaded mass can be an overweight weight, i.e. the total weight of the club head body plus overweight loaded mass is greater than the weight of a standard club head body. To make the golf swing trainer overweight by about 10% in comparison to a standard driver, the additional loaded mass will weigh approximately 45 g.

Figure 15:
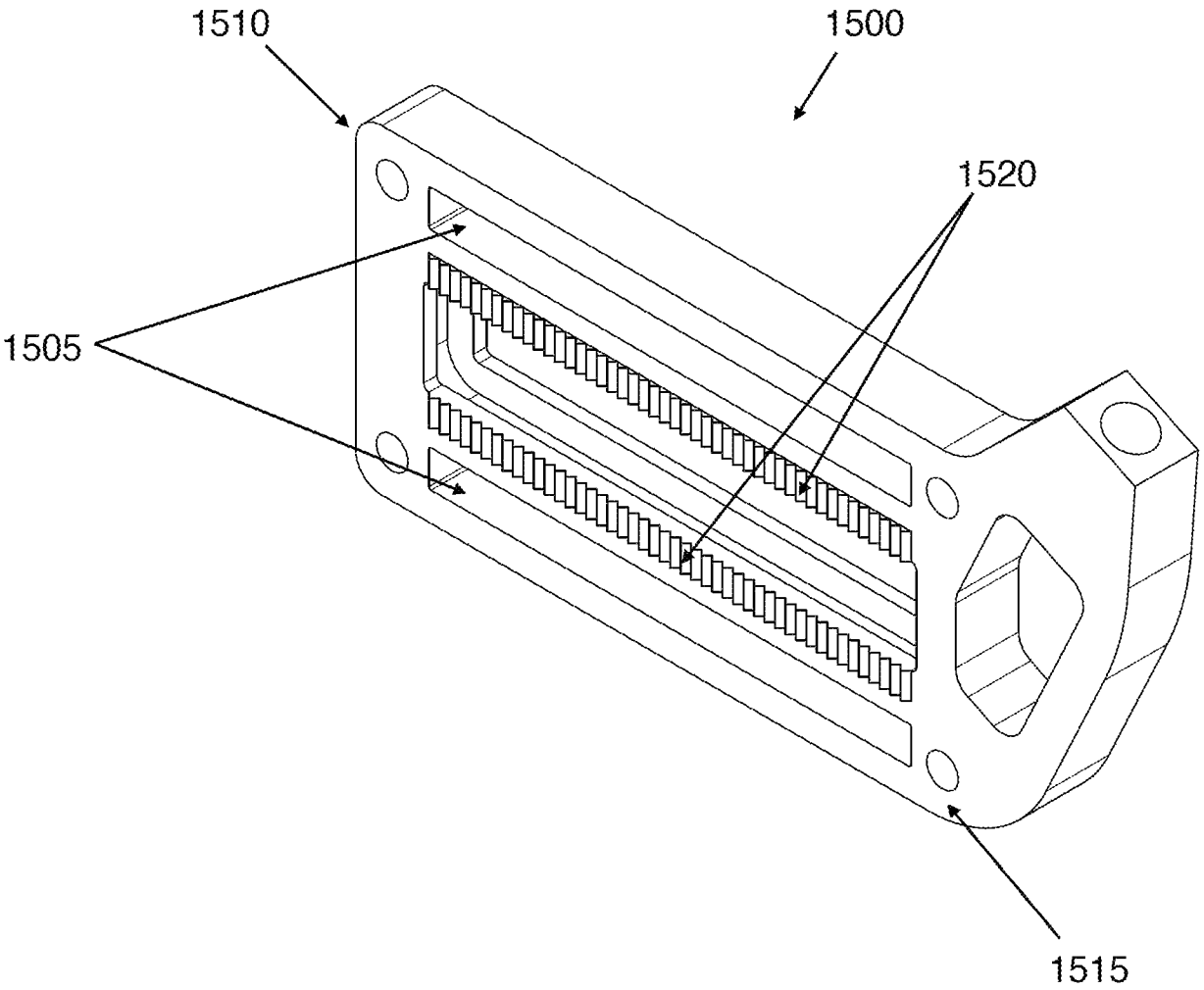
FIG. 15 is a perspective view of a trainer head with the fixed weight sliding mass removed according to another embodiment of the present invention.
Figure 16:
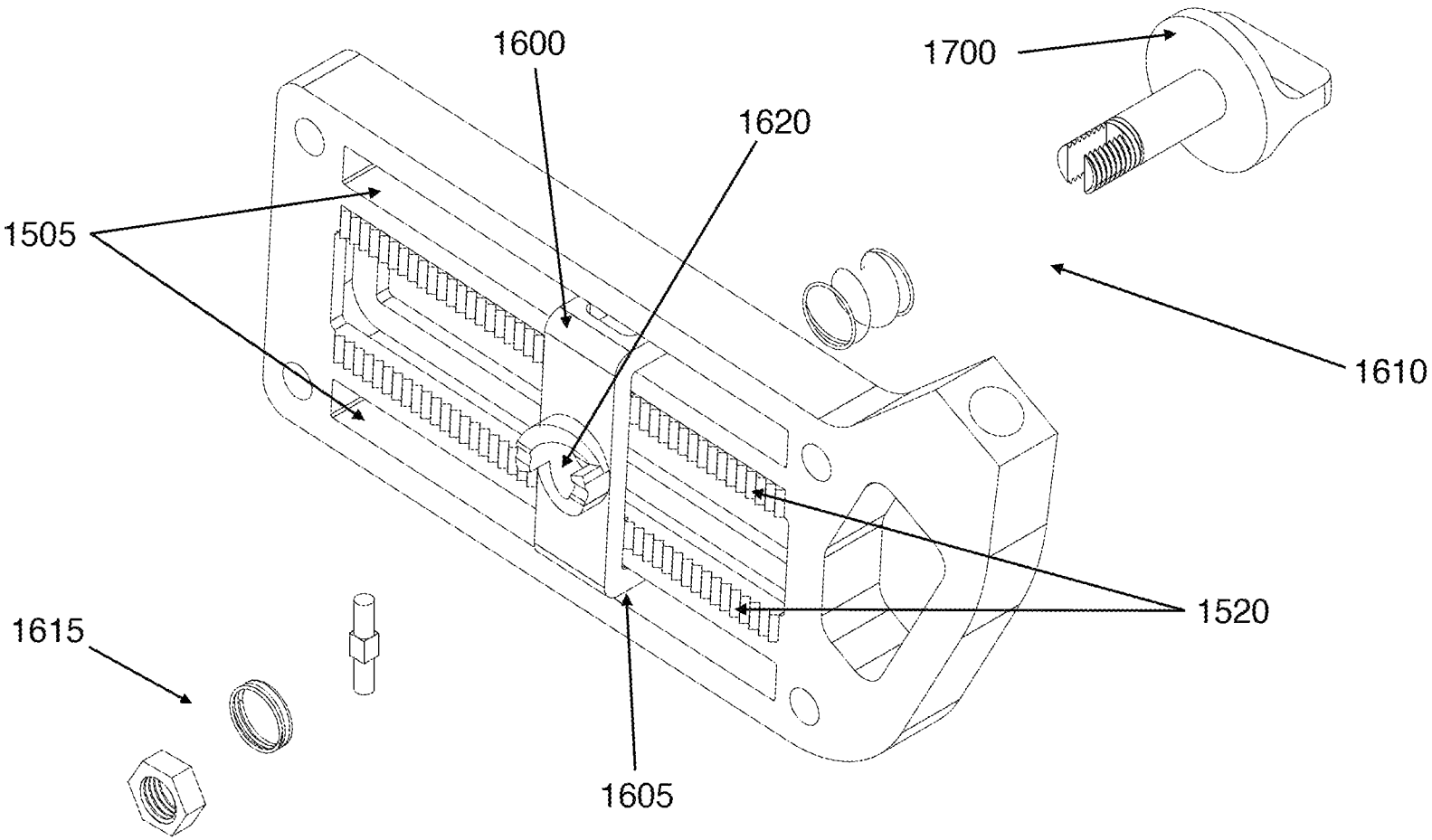
FIG. 16 is a perspective view of the trainer head shown in FIG. 15 with the fixed weight sliding mass slidably attached to a sliding track via a fastener, which is shown in an exploded view.
Figure 17:
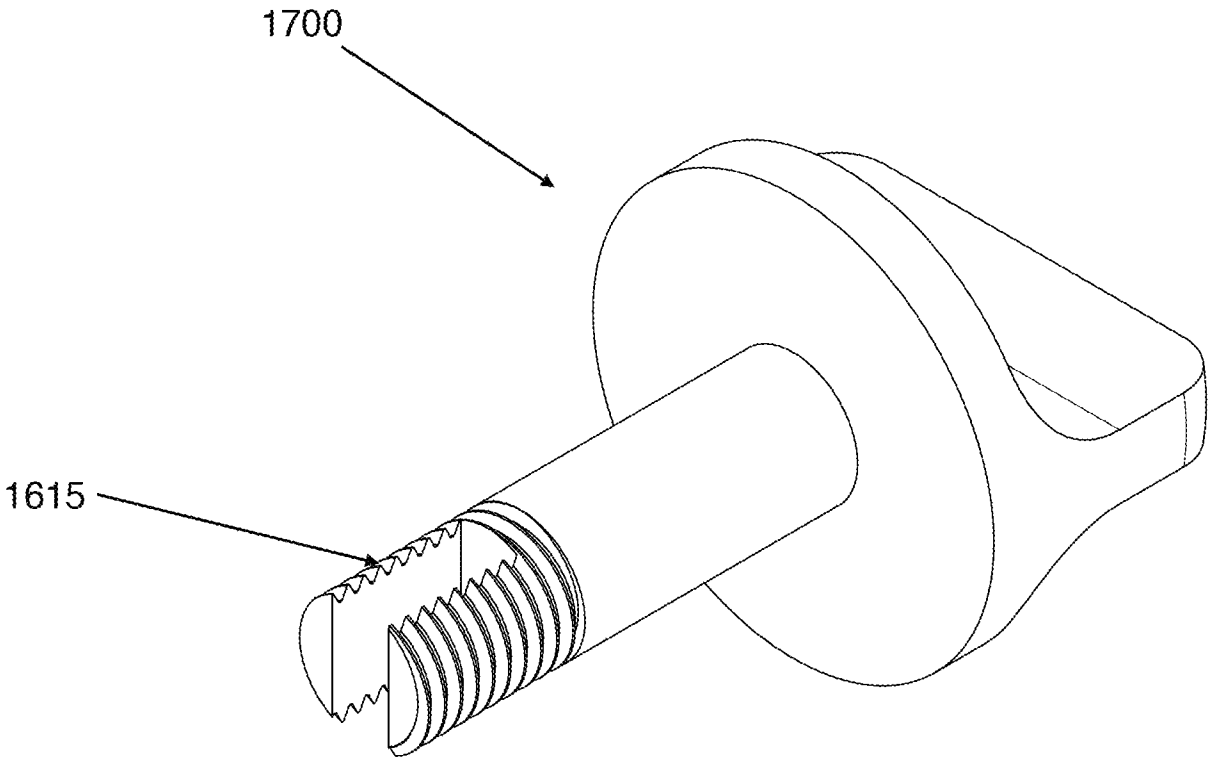
FIG. 17 is a perspective view of a knob of the exploded fastener shown in FIG. 16.

In a different embodiment shown in FIGS. 15-17, the golf club trainer club head (1500) is an elongated shape. The club head (1500) includes an exposed sliding track (1505) extending from a front edge (1510) to a rear edge (1515) of the club head (1500). A fixed weight sliding mass (1600), shown in FIG. 16, includes a latching mechanism (1605) configured to slidably attach to the sliding track (1505). The fixed weight mass (1600) is secured at a desired position along the sliding track (1505) by a locking mechanism. In the present embodiment, the locking mechanism includes a grooved track (1520) extending parallel to the sliding track (1505). The grooved track (1520) includes a plurality of grooves, each groove in the plurality of grooves being configured to secure the fixed weight sliding mass (1600) at a plurality of positions along the sliding track (1505). The locking mechanism further includes a fastener (1610) having a twistable knob (1700), as shown in FIG. 17, and a screw-and-nut assembly (1615), as shown in FIG. 16. The fastener (1610) is insertable through a cavity (1620) of the club head (1500) and the fixed weight sliding mass (1600). By twisting the twistable knob (1700) in a first direction to tighten the fastener (1610), the fixed weight sliding mass (1600) is secured in a selected groove of the grooved track (1520), thus preventing the fixed weight sliding mass (1600) from moving along the exposed sliding track (1505). To change the position of the fixed weight sliding mass (1600) along the sliding track (1505) and thus change the center of gravity and distribution of mass of the golf club trainer, the twistable knob (1700) must be twisted in a second direction to release the fastener (1610), thus allowing the fixed weight sliding mass (1600) to freely slide along the sliding track (1505) to a different desired position.

It should be understood by those skilled in the art that although the embodiment depicted in FIGS. 15-17 shows an elongated fixed weight sliding mass positioned parallel to a longitudinal face of the club head, various other shapes and orientations between the fixed weight sliding mass and the club head are possible and are not exhaustively detailed herein. Such variations in the weight, composition, and orientation of the components described above do not materially deviate from aspects described herein.

In many embodiments, the golf trainer grip is responsive and lightweight to ensure correct swing mechanics and avoid fatigue with usage. In some embodiments, the grip is a mixture of rubber and polymer like materials for a unique and custom grip for golf club users. In some embodiments, the grip reduces grip weight, thus increasing club control and minimizing wrist movement.

In some embodiments, a standard golf club shaft is used to provide the most realistic feel in the swing. The illustration in FIG. 10 conveys one embodiment of how the golf club shaft attaches to the hosel of the club head body. The illustration in FIG. 7 conveys one embodiment of the golf club head body. The illustration in FIG. 11C conveys another embodiment of the golf club head body. In some embodiments, the golf club shaft is attached to the hosel of the club head body (710), (1410) using an epoxy-based connection.

One skilled in the art will recognize that these embodiments are based on the size of a men's standard full-length club, but can be adjusted based upon the length of the shaft used in order to maintain the moment of inertia. In one embodiment, a men's standard full-length shaft has a moment of inertia equal to the (mass of the golf club head) x the (length of the shaft). In other embodiments, a shorter shaft can be used, and the mass of the club head can be changed proportionally in order to maintain the moment of inertia calculated from the men's standard full-length club.

While preferred embodiments of the present invention have been shown and described herein, it will be obvious to those skilled in the art that such embodiments are provided by way of example only. Numerous variations, changes, and substitutions will now occur to those skilled in the art without departing from the invention. It should be understood that various alternatives to the embodiments of the invention described herein may be employed in practicing the invention. It is intended that the following claims define the scope of the invention and that methods and structures within the scope of these claims and their equivalents be covered thereby.

It is to be appreciated that certain features which are, for clarity, described herein in the context of separate embodiments, may also be provided in combination in a single embodiment. Conversely, various features that are, for brevity, described in the context of a single embodiment, may also be provided separately or in any sub-combination. Further, reference to values stated in ranges include each and every value within that range. Values of weights provided herein are exemplary and for illustration purposes and are not exhaustive to preclude other possible values that may be implemented in other embodiments.

What is claimed is:

1. A golf club trainer, comprising:

a club shaft with a grip at a first distal end of the club shaft and a socket connector at a second distal end of the club shaft, the socket connector being configured to attach the club shaft to a club head; and the club head comprising:

a rectangular shape including a top edge having an opening, a bottom edge, a front edge, a rear edge, and at least two faces extending between the rear edge to the front edge;

a sliding track extending longitudinally both between and along the rear edge and the front edge;

a sliding weight insertable through said opening and attached to the sliding track that may be fixed, via a locking mechanism, in a plurality of predetermined positions along the sliding track such that each position of the plurality of predetermined positions corresponds to a noticeable change in a rotational resistance of the club head when the golf club trainer is swung by a user;

a hollow rear portion associated with the at least two faces and located rearward of the rear edge and adjacent to the sliding track; and a removable weight insertable within the hollow rear portion to adjust a total mass of the club head independently of the rotational resistance.

2. The golf club trainer according to claim 1, wherein the locking mechanism includes a grooved track extending along a longitudinal direction of the club head, and the grooved track includes a plurality of grooves, each groove in the plurality of grooves corresponding to a predetermined position of the plurality of predetermined positions.

3. The golf club trainer according to claim 2, wherein the locking mechanism further comprises a spring configured to engage the sliding weight and secure the sliding weight in a selected groove of the grooved track such that when the spring is biased, the sliding weight is released from the selected groove and may slide along the sliding track from the front edge to the rear edge of the club head, and when the spring is released, the sliding weight is secured in the selected groove such that movement along the longitudinal direction of the club head is prevented.

4. The golf club trainer according to claim 2, wherein the sliding weight includes a hole to accommodate a fastener and the locking mechanism further comprises the fastener including a twistable knob and a screw-and-nut assembly that releasably secures the sliding weight to a selected groove of the grooved track such that movement along the longitudinal direction of the club head is prevented, wherein the fastener is inserted through a cavity of the club head and the hole of the sliding weight.

5. The golf club trainer according to claim 1, further comprising the at least one weight being held in the hollow rear portion of the club head and releasably coupled via a spring loaded locking pin.

6. The golf club trainer according to claim 1, wherein a plurality of sliding weights may be slidably attached to the sliding track of the club head.

7. The golf club trainer according to claim 1, wherein the sliding track is exposed.

8. The golf club trainer according to claim 1, wherein a plurality of removable weights are insertable within the hollow rear portion to adjust a total mass of the club head independently of the rotational resistance.

9. The golf club trainer according to claim 1, further comprising the sliding weight is non-removable.

10. A method of adjusting a center of gravity and a distribution of mass of a golf club trainer, wherein the golf club trainer comprises:

a club shaft with a grip at a first distal end of the club shaft and a socket connector at a second distal end of the club shaft, the socket connector being configured to attach the club shaft to a club head; and the club head comprising:

a rectangular shape including a top edge having an opening, a bottom edge, a front edge, a rear edge, and at least two faces extending between the rear edge to the front edge;

a sliding track extending longitudinally both between and along the rear edge and the front edge;

a sliding weight insertable through said opening and attached to the sliding track that may be fixed, via a locking mechanism, in a plurality of predetermined positions along the sliding track such that each position of the plurality of predetermined positions corresponds to a noticeable change in a rotational resistance of the club head when the golf club trainer is swung by a user;

a hollow rear portion associated with the at least two faces and located rearward of the rear edge and adjacent to the sliding track; and a removable weight insertable within the hollow rear portion to adjust a total mass of the club head independently of the rotational resistance, the method comprising;

releasing the locking mechanism securing the sliding weight to the sliding track;

sliding the sliding weight along the sliding track to a position of the plurality of predetermined positions to adjust a distribution of mass of the club head;

securing the locking mechanism to prevent movement of the sliding weight along the sliding track of the club head; and inserting a removable weight within the hollow rear portion to adjust the total mass of the club head.

11. The method according to claim 10, further comprising:

inserting a different removable weight into the hollow rear portion a-rear-end of the club head; and securing the different removable weight via a spring-loaded locking pin.

12. The method according to claim 10, wherein the locking mechanism includes a grooved track extending along a longitudinal direction of the club head, and the grooved track includes a plurality of grooves, each groove in the plurality of grooves being configured to secure the sliding weight to a respective position of a plurality of positions along the longitudinal direction of the club head both between and along the front edge and the rear edge.

13. The method according to claim 12, wherein the locking mechanism further comprises a spring configured to engage the sliding weight and secure the sliding weight in a selected groove of the grooved track such that when the spring is biased, the sliding weight is released from the selected groove and may slide along the sliding track from the front edge to the rear edge of the club head, and when the spring is released, the sliding weight is secured in the selected groove such that movement along the longitudinal direction of the club head is prevented.

14. The method according to claim 12, wherein the locking mechanism further comprises a fastener including a twistable knob and a screw-and-nut assembly that releasably secures the sliding weight to a selected groove of the grooved track such that movement along the longitudinal direction of the club head is prevented.

15. The method according to claim 10, wherein a plurality of sliding weights may be slidably attached to the sliding track of the club head.

16. The method according to claim 10, further comprising inserting a plurality of removable weights within the hollow rear portion to adjust a total mass of the club head independently of the rotational resistance.

17. The method according to claim 10, further comprising the sliding weight is non-removable.

* * * * *